United States Patent [19]

Krutilla et al.

[11] Patent Number: 4,790,224

[45] Date of Patent: Dec. 13, 1988

[54] TRAVELLING GAP CONVEYOR CUTTING METHOD AND APPARATUS

[75] Inventors: Michael A. Krutilla, Chagrin Falls; John Klein, Fairview Park, both of Ohio

[73] Assignee: Belcan Corporation, Cincinnati, Ohio

[21] Appl. No.: 87,663

[22] Filed: Aug. 20, 1987

[51] Int. Cl.[4] ..... B26F 3/00; B26D 3/00

[52] U.S. Cl. ..... 83/53; 83/155; 83/155.1; 83/177; 198/345; 271/84; 271/200; 271/267; 271/275

[58] Field of Search ..... 83/53, 37, 155, 155.1, 83/177, 326, 271, 925 CC; 414/77; 198/339.1, 345; 271/84, 200, 267, 275

[56] References Cited

U.S. PATENT DOCUMENTS

| | | | |
|---|---|---|---|
| 3,262,348 | 7/1966 | Wiatt et al. . | |
| 3,332,819 | 7/1967 | Siempelkamp | 271/84 |
| 3,347,121 | 10/1967 | Wiatt . | |
| 3,451,300 | 6/1969 | Messinger . | |
| 3,465,630 | 9/1969 | Bruns . | |
| 3,499,355 | 3/1970 | Wiatt et al. . | |
| 3,541,907 | 11/1970 | Wiatt et al. . | |
| 3,559,524 | 2/1971 | Glastra . | |
| 3,573,859 | 4/1971 | Sederberg . | |
| 3,585,888 | 6/1971 | Wiatt . | |
| 3,589,222 | 6/1971 | Sederberg . | |
| 3,730,040 | 5/1973 | Chadwick et al. . | |
| 3,797,341 | 3/1974 | Bystron . | |
| 4,058,040 | 11/1977 | Fisher . | |
| 4,092,889 | 6/1978 | Fisher et al. . | |
| 4,112,797 | 9/1978 | Pearl . | |
| 4,116,097 | 9/1978 | Graham et al. . | |
| 4,137,804 | 2/1979 | Gerber et al. . | |
| 4,140,038 | 2/1979 | Higgins . | |
| 4,171,657 | 10/1979 | Halberschmidt et al. . | |
| 4,176,566 | 12/1979 | Patterson et al. . | |
| 4,185,815 | 1/1980 | Abbott et al. | 271/275 |
| 4,186,632 | 2/1980 | Leslie et al. . | |
| 4,328,726 | 5/1982 | Pearl . | |
| 4,391,170 | 7/1983 | Beverman et al. . | |
| 4,501,182 | 2/1985 | Jardat et al. . | |
| 4,567,796 | 2/1986 | Kloehn et al. . | |
| 4,573,382 | 3/1986 | Kloehn et al. . | |
| 4,681,501 | 7/1987 | Edwards et al. | 414/77 |

FOREIGN PATENT DOCUMENTS

| | | |
|---|---|---|
| 711212 | 1/1980 | U.S.S.R. . |
| 1287585 | 8/1972 | United Kingdom . |

*Primary Examiner*—Frank T. Yost
*Assistant Examiner*—Scott A. Smith
*Attorney, Agent, or Firm*—Wood, Herron & Evans

[57] ABSTRACT

A travelling slot cutting machine and method of cutting a workpiece upon the machine in which there are two independently operable and longitudinally aligned, endless conveyor belts, the adjacent ends of which are spaced apart to define a gap through which a cutting medium may be directed. To cut a workpiece supported over the gap, the cutting medium is directed through the gap while the cutting machine, as well as the gap, are moved longitudinally relative to the stationary workpiece. In moving the gap, the conveyors are clamped against movement over their respective supporting rollers. The supporting rollers are then moved in such a fashion that the length of at least one of the conveyor belts is maintained unchanged as the workpiece is transported from the upper run of one of the conveyor belts to the upper run of the other conveyor belts.

40 Claims, 6 Drawing Sheets

TRAVELLING GAP CONVEYOR CUTTING METHOD AND APPARATUS

This invention relates to conveyorized machines, and more particularly, to machines having a slotted workpiece support table defined by a flexible conveyorized support surface.

In the cutting of large sheets of flexible material, such as leather or fabrics, support must be provided for the material while it is being cut. However, the material must not move during cutting in order to maintain proper orientation of the material relative to the cutting tool. This orientation of the material or workpiece relative to the cutting tool is particularly critical in the case of numerically controlled or computer controlled machinery.

Oftentimes, flexible material is cut by fluid jets wherein the jet must be tracked by a catcher device on the opposite side of the flexible material from the fluid jet nozzle such that the material is sandwiched between the nozzle and the catcher device. The catcher device is generally positioned as close as possible to the exit of the fluid jet stream so as to reduce noise and wetting of the workpiece material. Placement of a fluid jet catcher device beneath the workpiece obviously reduces or compromises the support of the workpiece material since the material cannot be supported on the underside in the area of the catcher device.

In the past, prior art fluid jet cutting machines typically, and knife or other cutting machines as well, have incorporated a belt mechanism for supporting flexible workpieces wherein the belt mechanism defines a slot beneath the fluid jet or knife, which slot travels beneath the workpiece material with the movement of the fluid jet or knife. This type of traveling slot, conveyorized cutting machine is exemplified by U.S. Pat. Nos. 3,262,348 and 3,347,121.

Traveling slot conveyorized machines have the advantage of providing workpiece support adjacent the cutter mechanism and of providing support for the cutting device or cutting fluid catcher device on the opposite side of the workpiece from the cutter. However, such traveling slot cutter machines generally require a complicated mechanism located on the opposite side of the workpiece from the cutter or nozzle side, which mechanism is expensive and is subject to becoming contaminated by cutting fluid, cutter chips, filings, etc., which fall into the mechanism located on the side of the conveyor remote from the cutter or cutter nozzle.

In order to overcome the problems associated with having a slot conveyor mechanism located immediately beneath the traveling slot of a slotted belt conveyor, as in the above-identified patents, a two-conveyor belt arrangement having a traveling slot defined between adjacent ends of the two belts has been developed. The two-belt arrangement is the subject of British Pat. No. 1,287,585. According to the disclosure of this British patent, one conveyor is lengthened while the other is shortened so as to effect movement of the slot defined between the adjacent ends of the two conveyors. In order to vary the length of the two conveyors, though, a complex pulley mechanism is required to take up slack and shorten one conveyor and to give up slack and lengthen the other conveyor. The shortcoming of this arrangement is that it requires a relatively complex mechanism and requires a relatively long conveyor in order to create the traveling slot. It also requires a very substantial, complex mechanism beneath the conveyors, and requires a substantial height for the complex mechanism beneath the conveyor.

It has therefore been an objective of this invention to provide a traveling slot cutting machine which is less complex and less expensive than prior art traveling slot belt conveyors of the type described hereinabove.

Still another objective of this invention has been to provide an improved traveling slot belt conveyor wherein the area of the conveyor immediately beneath the traveling slot is free of conveyor mechanism and available for use by portions of the cutter or cutter fluid catching mechanism.

Still another objective of this invention has been to provide a relatively inexpensive, and yet shorter, traveling slot belt conveyor than prior art traveling slot conveyors.

Still another objective of this invention has been to provide a traveling slot belt conveyor wherein finished cut workpieces may be unloaded from the machine, while simultaneously, new uncut workpieces are loaded into the machine.

The cutting machine of this invention which accomplishes these objectives comprises two individual, independently operable, endless belt conveyors, the upper runs of which are movable in a common horizontal plane and between the adjacent ends of which there is a longitudinal gap. Cutting means are extendible through this gap. In one preferred embodiment, the cutting means comprises a fluid jet located above the gap and a fluid catcher mechanism located beneath the gap. The cutting means, though, could as well be any conventional cutter, such as lasers, flames, EDM, diamond wires, bandsaws, reciprocating knives, or the like. In accordance with this invention, the gap between the adjacent ends of the conveyors and the cutting means are longitudinally movable relative to a stationary workpiece which is initially supported upon the upper run of one conveyor, and which, in the course of movement of the gap and cutting means, is transferred to the upper run of the other conveyor. In accordance with the invention of this application, the length of the upper run of at least one of the conveyors is maintained fixed while the length of the upper run of the other conveyor may vary or may be fixed. In the course of transporting the stationary workpiece from the upper run of one conveyor to the upper run of the other conveyor, the workpiece supporting upper runs of the two conveyors are clamped relative to the machine frame.

In one preferred embodiment of this invention, the length of the upper run of one conveyor is shortened, while the length of the upper run of the other conveyor is maintained fixed as the gap between the two conveyors travels beneath the workpiece. In another embodiment, the length of the upper run of both conveyors remains fixed as the gap between the two conveyors moves beneath the stationary workpiece.

In that embodiment of the invention in which the upper run of one conveyor is shortened while the upper run of the other conveyor remains unchanged, an auxiliary take-out conveyor is provided adjacent one end of the machine. This take-out conveyor normally resides in a position above the fixed length belt conveyor, but is dropped down into alignment with the upper run of the fixed length belt conveyor after a workpiece has been cut and preparatory to removal of the workpiece from the machine. In this embodiment, the workpiece is conveyed onto the take-out conveyor preparatory to movement of a new workpiece into the machine. After the finished or cut workpiece has been placed on the take-out conveyor, the take-out conveyor is removed from alignment with the fixed length belt conveyor so that the other two belt conveyors of the machine may be returned to their starting position with a new workpiece loaded into the machine.

In yet another embodiment of the invention, the belt conveyors are mounted upon independent frames, which independent conveyor frames are so constructed that they can be removed from the machine for purposes of loading or unloading workpiece material thereon. This embodiment therefore presents a palletizing arrangement for loading and unloading workpieces into and out of the machine. The palletized conveyors may be loaded and unloaded from the same end of the machine or may be fed through the machine in a continuous mode of operation.

The advantage of this invention is that it provides a traveling gap, belt conveyor cutting machine wherein there is no mechanism located beneath the traveling gap to interfere with the cutting mechanism, or if the cutter is a fluid jet, to interfere with the catcher mechanism which travels with the cutter and with the gap. This cutting machine also has the advantage of providing a rlatively short length and short height machine which is capable of being unloaded, while simultaneously, product is loaded into the machine. It also has the advantage of being very flexible in terms of methods or procedures by which workpiece material may be loaded and unloaded into and out of the machine.

These and other objects and advantages of this invention will be more readily apparent from the following description of the drawing in which.

Figure 1:
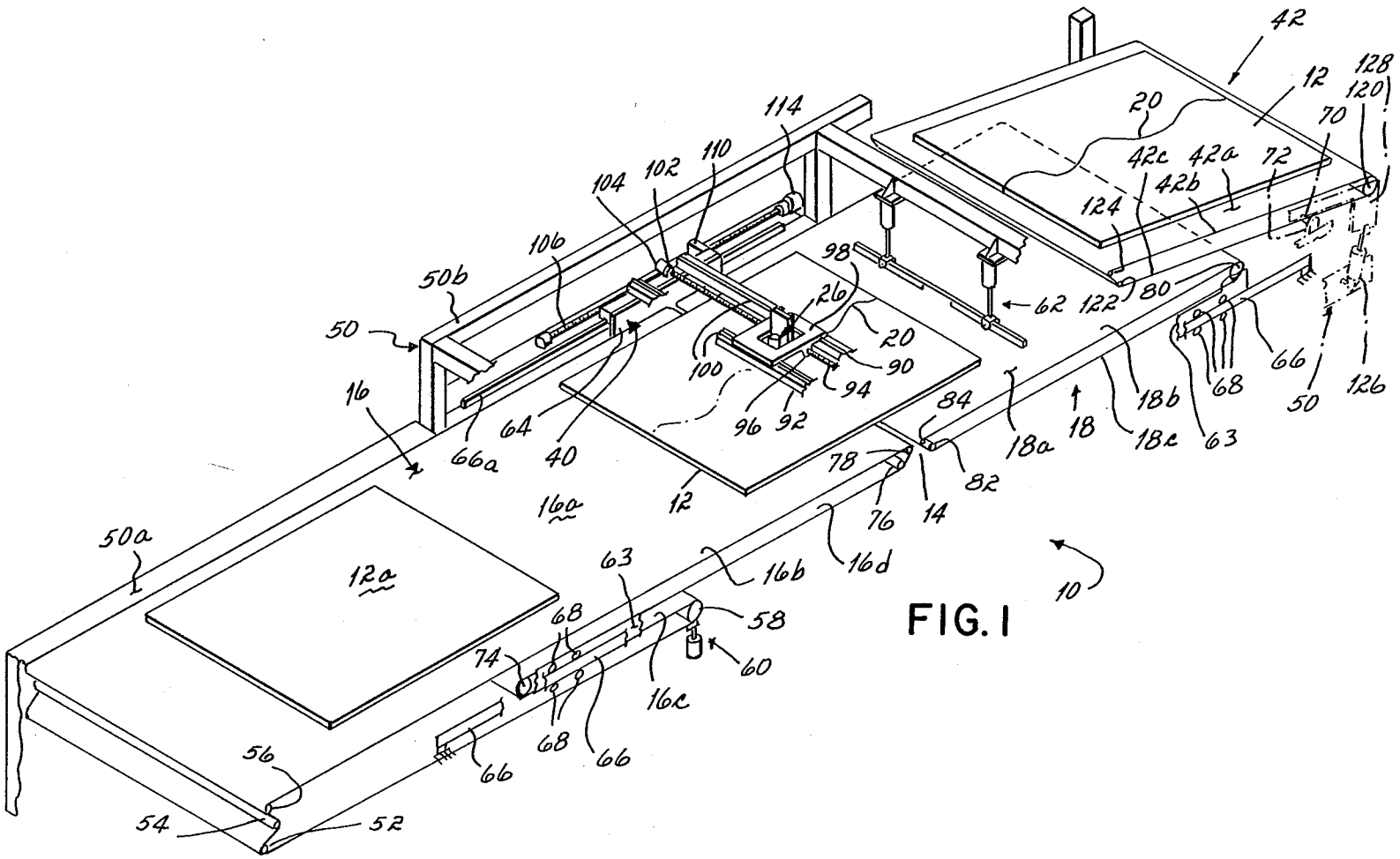
FIG. 1 is a perspective view, partially broken away, of a cutting machine incorporating the invention of this application.
Figures 2A, 2B, 2C, 2D, 2E, 2F:
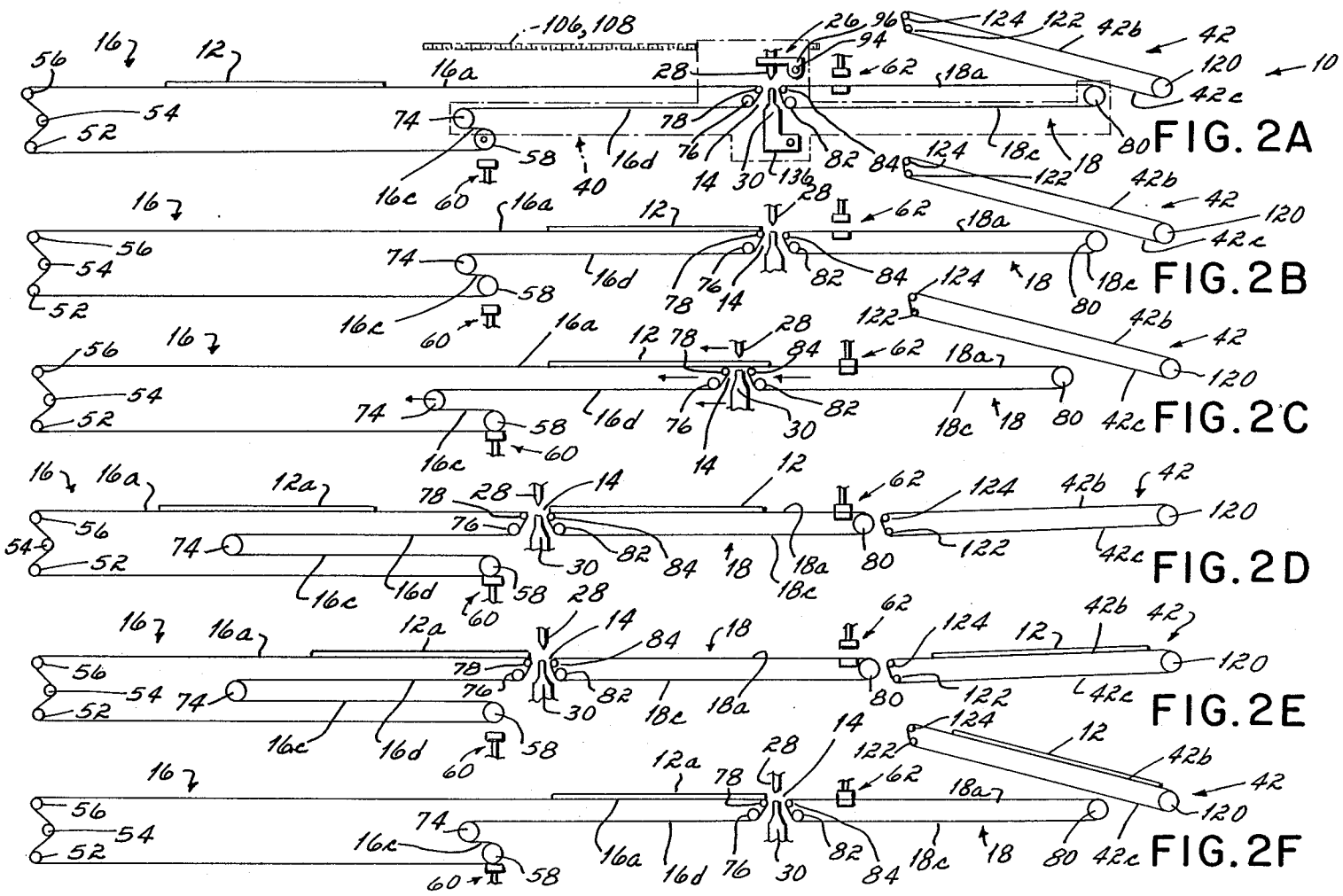
FIGS. 2A–2F are partially diagrammatic, side elevational views of the machine of FIG. 1, illustrating the sequence of operations to load workpieces into the machine, process those workpieces, and unload the workpieces from the machine.
Figure 3:
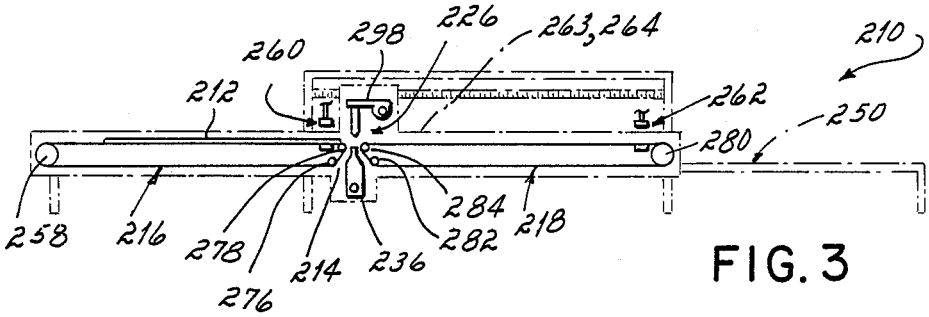
FIG. 3 is a partially diagrammatic, side elevational view of a second embodiment of a cutting machine incorporating the invention of this application.
Figure 3A:
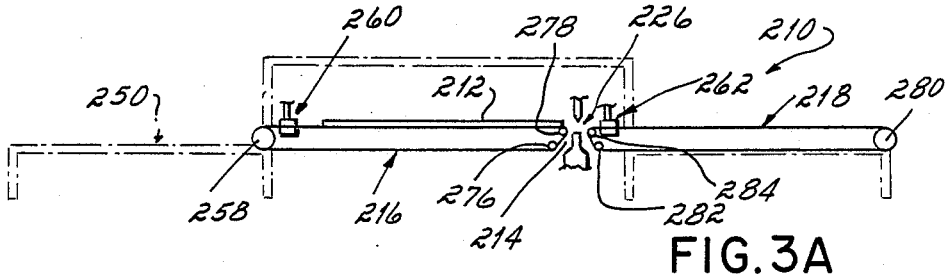
FIGS. 3A–3D are partially diagrammatic, side elevational views of the machine of FIG. 3 illustrating the sequence of operations to load workpieces into the machine, process those workpieces, and unload the workpieces from the machine.
Figure 3B:
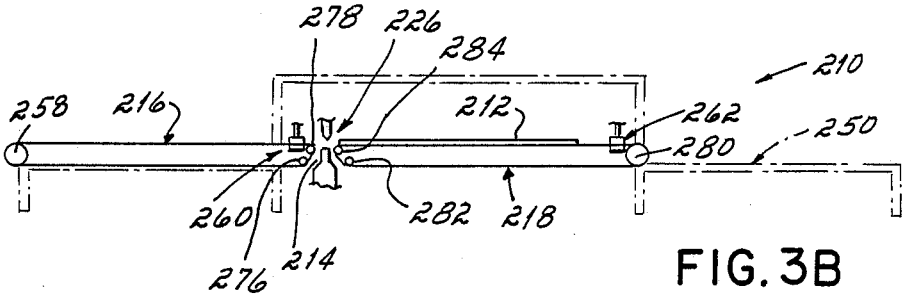

With reference first to FIGS. 1–3, there is illustrated a first embodiment of the traveling slot cutting machine 10 of this invention. This machine is a fluid jet cutter machine operable to cut workpieces 12 while those workpieces are supported over a gap or so-called traveling slot 14 defined between adjacent ends of a pair of independently operable conveyors 16 and 18. While the invention is described relative to a fluid jet cutter machine, it will be appreciated that any type of conventional cutter may be used in the practice of this invention and may be substituted for the fluid jet cutter illustrated and described herein.

As explained more fully hereinafter, the gap or traveling slot 14 defined between the adjacent ends of the conveyors 16, 18 traverses beneath a stationary workpiece while the fluid jet cutting mechanism moves in synchronization with the gap and makes a longitudinal, or combination of longitudinal and transverse, cut 20 in the workpiece supported atop the two conveyors.

In order to make the cut in the workpiece, high pressure liquid from a pressurized source 22 of such liquid is supplied through a flexible conduit 24 to a fluid jet cutter mechanism 26 mounted above the gap or traveling slot 14. In one preferrred practice of this invention, the workpieces 12 are sheets of leather-like shoe material which are cut by liquid supplied to the fluid jet cutter mechanism 26 at a pressure on the order of 50,000 p.s.i. In order to effectively cut the workpiece 12, the nozzle 28 (FIG. 2A) of the jet cutter mechanism 26 is preferably located as close as possible to the top surface of the workpiece, and a catcher mechanism 30 operative to catch liquid from the fluid jet cutter mechanism is located beneath the fluid jet mechanism. The catcher is preferably located as close as possible to the underside of the workpiece. The fluid jet catcher mechanism 30 is mounted beneath the traveling slot or gap 14 and moves both transversely and longitudinally in synchronization with the movement of the fluid jet cutter mechanism 26.

In the practice of this invention, the workpiece is maintained stationary on the upper run **16*a*, 18*a* of the conveyors 16 and 18, respectively, while the gap 14 between the conveyors is moved relative to the stationary workpiece. Because the workpiece remains stationary, the fluid jet cutter mechanism 26 must move relative to the workpiece in accordance with a predetermined pattern in order to cut that predetermined pattern. To that end, there is a controller 32** which, as explained more fully hereinafter, controls movement of the fluid jet cutter mechanism. That controller is conventional and per se, forms no part of the invention of this application. It may be a conventional numerical control or a conventional computer control mechanism.

In order to transport workpieces 12 into the machine over the belt conveyor 16 or to transport workpieces out of the machine over the conveyor belt 18, the conveyor belts **16*b*, 18*b* are movable as a result of rotation of their respective supporting rollers. However, to effect movement of the traveling slot or gap, the belts 16*b*, 18*b* are clamped against movement, and while the belts remain clamped against movement, their supporting rollers are moved so as to cause longitudinal movement of the gap 14 between adjacent ends thereof. To synchronize movement of the conveyor supporting rollers and thus of the traveling slot or gap 14, with movement of the fluid jet cutter mechanism 26, the longitudinally movable rollers of the conveyors are attached to a movable carriage 40 having slides 63, 64 located on opposite sides of the machine. These slides carry both the fluid jet cutter mechanism and the movable rollers of the conveyors longitudinally of the machine. Thereby, the traveling slot or gap 14** moves longitudinally with, and in synchronization with, the fluid jet cutter mechanism.

The preferred modification of the invention illustrated in FIGS. 1–3 includes a take-out conveyor 42. This conveyor normally resides in a position above the two belt conveyors 16 and 18 of the cutter machine 10. After a cut upon a workpiece has been completed, the take-out conveyor 42 is lowered into horizontal alignment with the two conveyors such that a completed workpiece may then be transported onto the take-out conveyor 42 and transported out of the machine. As soon as the workpiece has been placed upon the take-out conveyor, the take-out conveyor is moved upwardly out of alignment with the two conveyors 16 and 18 of the machine. The conveyors of the machine, as well as the fluid jet cutter of the machine and a new workpiece, may then be repositioned for initiation of the start of a new cycle upon the new workpiece while the finished workpiece continues to be transported out of the machine. Thereby, removal of the finished workpiece from the machine does not slow movement of a new workpiece into the machine.

Machine Frame

Figure 1A:
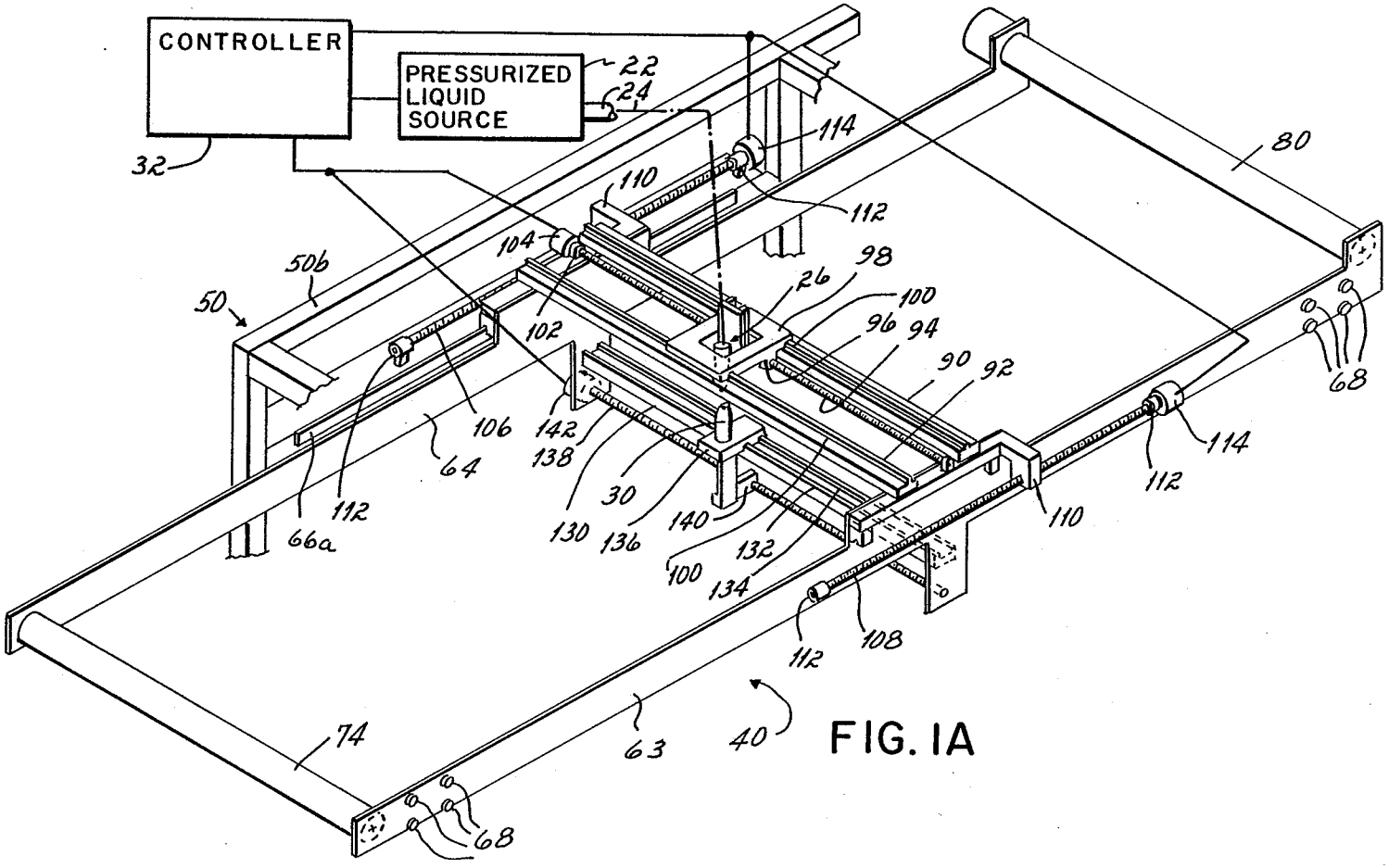
FIG. 1A is an enlarged perspective view of a portion of the machine of FIG. 1 with the conveyor belts and take-out conveyor removed in order to more clearly illustrate selected portions of the machine of FIG. 1.

The machine frame 50 has only been partially illustrated in FIGS. 1 and 1A in order to more clearly illustrate the invention of this application. This frame comprises a base section **50*a* and an upper support section 50*b*. The base section of the frame supports three idler rollers 52, 54, 56 of the variable length conveyor 16, as well as a drive roller 58 of that same conveyor. It also supports the clamps 60, 62 for securing the belts 16*b*, 18*b* of the conveyor 16 and 18** against movement relative to the belt supporting rollers.

The side cars or slides 63, 64 of carriage 40 are mounted on opposite sides of the conveyors for longitudinal movement with respect to the fixed frame 50. Each slide 63, 64 is movable over fixed slide supporting ways **66, 66*a* fixedly secured to each side of the frame 50. The ways 66 support the opposite ends of the carriage 40 while the ways 66*a* support the center section or so-called gantry section of the carriage. The ways 66 have upper and lower surfaces over which rollers 68 of the slides are movable. The rollers 68 preferably have grooves or channels in their peripheral surface engaged with the top and bottom surfaces or edges of the slide supporting ways so as to maintain the rollers and attached slide in alignment on the ways. The rollers 68 in turn are rotatably mounted upon the slides 63, 64 such that the slides are free to move longitudinally over the ways 66**.

The ways **66*a*, only one of which is illustrated in FIG. 1, support opposite ends of the center section or so-called gantry section of the carriage 40. These ways are carefully machined and separated from the end sections 66** of the ways which need not be so carefully and accurately machined.

As explained more fully hereinafter, the base section **50*a* of the frame 50 also supports the take-out conveyor 42 for pivotal movement into and out of alignment with the conveyors 16 and 18 about pivot axles 70 of the take-out conveyor. These pivot axles 70 are journaled for rotation in supporting blocks 72** secured to the frame.

Carriage Supporting Slides

The slides 63, 64 extend for a major portion of the length of the machine and are interconnected by transverse crossbars 90, 92 so that the slides move longitudinally in parallel over the ways 66 of the machine. Each slide 63, 64 supports one end of three idler rollers 74, 76, 78 of the variable length conveyor 16. Each slide also supports the drive roll 80, as well as the idler rollers 82, 84 of the fixed length conveyor 18. Consequently, as the slides 63, 64 move longitudinally relative to the frame, the slides carry with them these rollers 74, 76, 78, 80, 82 and 84 of the conveyors 16 and 18.

The slides 63, 64 also support and transport transversely movable saddles 98, 136 over the frame. These saddles 98, 136 are supported upon the ways 100 of the three transverse bars 90, 92, 130 which extend between the slides 63, 64. A screw 94 extends through a nut 96 secured to the underside of the upper saddle 98. Opposite ends of the screw 94 are journaled for rotation in journal blocks 102 mounted upon the slides 63, 64. The screw 94 is driven from a conventional motor 104 under the control of the control mechanism 32.

A pair of guide ways 132, 134 are located on the top surface of the transverse bar 130. These ways function to support the lower catcher saddle 136 which is movable transversely over the ways 132, 134 under the control of a drive screw 138. The screw 138 extends through a nut 140 attached to the saddle 136 and has its opposite ends rotatably journaled in the slides 63, 64. A motor 142 is mounted on the slide 64 and is operative to drive the screw 138 in synchronization with the upper saddle drive screw 94. The motor 142 is driven from the control unit 32 in synchronization with the drive of the motor 104 so that the saddle 98 and the saddle 136 move in synchronization transversely between the two slides. Thereby, the liquid catcher 30 is maintained in vertical alignment immediately beneath the nozzle 28 of the fluid jet cutting mechanism 26.

Longitudinal movement of the carriage 40 and slides 63, 64 is under the control of a pair of screws 106, 108 located on opposite sides of the machine. These screws pass through threaded nuts 110 attached to the sides of the slides. The screws are in turn each journaled for rotation in journal blocks 112 fixedly secured to the base section **50*a* of the frame 50. Each screw is driven by a motor 114 under the control of the control mechanism 32**. The control is operative to drive the two screws in synchronization so as to maintain parallelism of the slides as they move over the ways of the machine frame.

As will now be readily apparent, actuation of the motors 114 and thereby of the screws 106, 108 effect longitudinal movement of the carriage 40 and the saddles 98, 136 mounted thereon. Actuation of the motors 104, 142 and the attached drive screw 94 effects transverse movement of the saddles 98, 136. Simultaneous actuation of the motors 114, 104, 142 effects simultaneous longitudinal and transverse movement of the saddles and of the fluid jet cutting mechanism 26 and catcher 30 mounted upon the saddle.

Variable Length Conveyor

The conveyor belt **16*b* is an endless conveyor having an upper run 16*a* which extends between the idler rollers 56 and 78. The belt extends from the idler roller 78 downwardly around the idler roller 76 and then back to and around the idler roller 74 and then forwardly to drive roller 58. From the drive roller 58, the belt extends rearwardly to and around the idler roller 52 and then upwardly around the idler roller 54 back to and around the idler roller 56. When the belt is clamped by the clamp 60 moving upwardly so as to clamp the belt to the drive roller, the belt is no longer free to move relative to the rollers. But, those rollers 74, 76, 78 of the conveyor 16 which are mounted upon the slides 63, 64 are free to move with the slides, thereby shortening the upper run 16***a* of the variable length conveyor 16 while lengthening an intermediate run 16*c* between rollers 74 and 58. As the slides 63, 64 move to the left, as illustrated in FIGS. 1 and 2, the idler rollers 74, 76 and 78 simultaneously move to the left, thereby shortening the upper run 16*a* of the variable length conveyor 16. This leftward movement of the slide maintains the length of the top intermediate run 16*d* located between the rollers 74 and 76 and lengthens the lower intermediate run 16*c* of the conveyor located between the rollers 74, 58. As will be readily apparent, the shortening of the upper run 16*a* of the conveyor 16 results in a corresponding lengthening of the intermediate run 16*c*. Thereby, any slack in the conveyor belt is avoided as a consequence of leftward movement of the slides 63, 64. Alternatively, when the slides are moved to the right, as viewed in FIGS. 1 and 2, the rollers 74, 76, 78 are caused to move to the same extent to the right, thereby lengthening the upper run 16*a* of the conveyor 16 while simultaneously shortening the intermediate run 16*c*.

Fixed Length Conveyor

The conveyor belt 18*b* of the conveyor 18 extends from the idler roller 84 forwardly to and around the drive roller 80 and then rearwardly back to and around the idler roller 82. This belt is also an endless conveyor belt, but it is of a fixed length. Otherwise expressed, when the belt is clamped by the clamp 62 such that the belt cannot move relative to the machine frame because of its being secured against movement by the clamp 62, movement of the slides 63, 64 and of the rollers 80, 82, 84 attached to that slide does not effect any change in the length of the upper run 18*a* or the lower run 18*c* of this conveyor. The rollers 80, 82, 84 of this conveyor simply move to the left when the slides 63, 64 move to the left, as viewed in FIGS. 1 and 2, while that portion of the belt between the clamp 62 and the roller 84 remains stationary. The result is leftward movement of the conveyor, but with the portion of the upper run of the belt located between the clamp 62 and the idler roller 84 remaining stationary.

Take-Out Conveyor

The take-out conveyor 42 is also an endless belt conveyor. It has a drive roll 120, as well as two idler rollers 122, 124. The belt 42*a* of this take-out conveyor 42 has an upper run 42*b* which extends between the idler roller 124 and the drive roller 120, and a lower run 42*c* which extends between the drive roller 120 and the idler roller 122. As mentioned hereinabove, this take-out conveyor normally resides above the fixed length conveyor 18. It is pivotally mounted upon the pivot axles or posts 70 such that it can be pivoted about those posts so as to effect movement of the idler roller 124 of take-out conveyor 42 into horizontal alignment with the belt conveyors 16 and 18 of the machine 10. This movement is effected by a pneumatic piston motor 126, one end of which is attached to the frame 50 and the other end of which is attached to the frame 128 of the take-out conveyor 42. When the piston of the motor 126 is extended, it causes the forward or right end of the take-out conveyor to be lifted upwardly, thereby pivoting the take-out conveyor about the pivot posts 70. This results in the rearward end of the conveyor, including the idler rollers 122, 124, being lowered so as to position the upper run 42*b* of the conveyor in alignment with the upper runs 16*a*, 18*a* of the conveyors 16 and 18, respectively. The take-out conveyor, though, is only lowered into horizontal alignment with these conveyors when the slides 63, 64 have been moved to their leftwardmost extent such that the fixed length conveyor 18 is not below or is out of vertical alignment with the take-out conveyor 42. At that time, the take-out conveyor can be lowered under the control of the control unit 32 and, as illustrated in FIG. 2D, so as to form a continuation of the three conveyors. When the take-out conveyor is lowered, the drive roll 120 of the take-out conveyor may be driven by a motor (not shown) mounted thereon and under the control of the control unit 32 so as to convey a workpiece from the separately driven, fixed length conveyor 18 onto the take-out conveyor 42.

Machine Operation

The operation of the traveling slot cutting machine 10 is best illustrated in FIGS. 2A–2F. As there illustrated, a machine cycle is initiated with the carriage supporting slides 63, 64, as well as the attached saddles 98 and 136, in their rightwardmost position as illustrated in FIG. 2A. In this position of the slides, the traveling slot 14 is in its rightwardmost position with the fluid jet cutting machine having its nozzle 28 located immediately above the slot and the catcher 30 located immediately beneath the slot. The fixed length conveyor 18 is in its rightwardmost position with the take-out conveyor 42 in a raised position where it does not interfere with movement of the fixed length conveyor 18.

A cutting cycle is initiated by placement of a workpiece 12 onto the upper run 16*a* of the variable length conveyor 16. After placement of the workpiece 12 onto the variable length conveyor, the drive roll 58 of the conveyor 16 is caused to be driven by the control unit 32 so as to move the workpiece 12 rightwardly over the upper run 16*a* of the conveyor 16 until the rightwardmost edge of the workpiece 12 is positioned adjacent the edge of the traveling slot 14. The conveyor belt clamps 60, 62 are then caused to be actuated so as to clamp the belts 16*b*, 18*b* of the conveyors 16 and 18 against any movement relative to the machine frame 50. The fluid jet cutter machine 26 is then actuated under the control of the control unit 32 so as to cause a high pressure jet stream to issue from the nozzle 28 of the fluid jet cutter 26 and to be received within the catcher 30 located immediately beneath the nozzle of the fluid jet cutter 26. The motors of the drive screws 106, 108 are then actuated under the control of the control unit 32 so as to cause those screws to be driven synchronously in rotation and effect leftward movement of the slides, as well as the saddles 98, 136 mounted thereon. The rate at which the slides move is under the control of the control unit 32. Simultaneously, the transverse screws 94, 138 may be actuated under the control of the motors 104, 142 so as to effect transverse movement of the saddles 98, 136 and thereby the fluid jet cutting machine 26 and catcher 30. A cut 20 is initiated in the workpiece as a consequence of relative movement of the jet cutting machine and the stationary workpiece 12. As the carriage 40 is caused to move to the left, the gap 14 moves therewith. Gap 14 movement results from leftward movement of the idler rollers 74, 76, 78 of the variable length conveyor, as well as all of the rollers 80, 82, 84 of the fixed length conveyor, while the belts **16*b*, 18*b* mounted thereon are restrained against movement relative to the machine frame by clamps 60, 62. This leftward movement of the slides 63, 64 and the carriage 40 continues until the workpiece 12 has been completely cut, as illustrated in FIG. 2D. At this point in time, the workpiece 12 will be supported solely upon the upper run 18*a* of the fixed length conveyor 18, and the fixed length conveyor will be in a leftwardmost position in which it is out of vertical alignment with the take-out conveyor 42. The take-out conveyor is then lowered (FIG. 2D) under control of the control unit 32 into horizontal alignment with the belt conveyors 16 and 18. The drive rolls 80 and 120 of the fixed length conveyor 18 and the take-out conveyor 42, respectively, are then caused to be driven, after unclamping of the belt 18*b*, so as to transport a finished workpiece 12 from the fixed length conveyor 18 onto the take-out conveyor 42 (FIG. 2E). Simultaneously, a new workpiece 12*a* is loaded onto the upper run 16*a* of the variable length conveyor or infeed conveyor 16. The take-out conveyor 42 is then raised to a position out of horizontal alignment with the belt conveyors 16 and 18. With both belts unclamped, the drive roll 58 of the conveyor 16 is then caused to be driven by the control unit 32 so as to position the new workpiece 12*a* adjacent the edge of the gap or slot 14 while simultaneously, the screws 106, 108 are caused to be driven to move the slides 63, 64 and attached saddles 98, 136 back to the original rightmost starting position (FIG. 2F). The machine 10** is now ready to repeat this machinery or cutting cycle.

The traveling slot cutting machine 10 described hereinabove has several advantages over prior art machines. One of these advantages is the relatively short length of the machine and the lack of mechanism on the underside of the machine.

Second Modification of Invention

With reference now to FIG. 3, there is illustrated a second modification of the invention of this application. This modification is very similar to the first embodiment. It differs from the first embodiment principally in that the first or infeed conveyor 216 is a fixed length conveyor, rather than a variable length one. The second conveyor 218 is also a fixed length conveyor. In other words, this modification utilizes two fixed length conveyors to define a moving slot or gap 214 between the adjacent ends thereof, rather than one variable and one fixed length conveyor.

This second embodiment of a fluid cutting machine 210 comprises a fixed frame 250 upon which there is slidably mounted a pair of carriage supporting slides 263, 264. These slides are the equivalent of the carriage support slides 63, 64 of the first embodiment. As in the first embodiment, these slides are located on opposite sides of the machine and are movable over ways fixedly attached to the frame 250. The slides rotatably support the drive roll 258, as well as the idler rolls 276, 278, of the first or infeed conveyor 216. The slides also rotatably support the drive roll 280, as well as the idler rollers 282, 284, of the second conveyor 218. Consequently, both of these fixed length conveyors move linearly over the frame in synchronization with movement of the slides 263, 264 to which the conveyors are mounted.

As in the first embodiment, there is a cutter supporting saddle 298 and a catcher saddle 236 mounted for transverse movement between the slides 263, 264. Longitudinal movement of the slides effects movement of the jet cutting device 226 and of the fluid jet catcher, along with movement of the rollers of the conveyors 216, 218.

The operation of this second modification of cutter machine 210 is illustrated in FIGS. 3A–3D. As illustrated in FIG. 3, a workpiece 212 is first loaded onto the upper run of the conveyor 216. At this time, the slides of the machine, as well as the carriage and cutter 226, are in their leftwardmost position. A work cycle is initiated by movement of the carriage slides 263, 264 and attached saddles 298, 236 rightwardly, thereby transporting the conveyors 216, 218 with the workpiece mounted atop the conveyor 216 to their rightwardmost positions (illustrated in FIG. 3A). The clamps 260, 262 are then closed so as to lock the belts of the conveyors 216, 218 against movement. The cutter is then actuated and the slides are moved leftwardly. With the upper runs of the belts clamped against movement, the workpiece does not move relative to the machine frame 250 as the slides and the rollers of the conveyors mounted thereon are moved leftwardly. When the slides and conveyor rollers mounted thereon, along with the jet cutter unit, reach their leftwardmost position (illustrated in FIG. 3B), the workpiece 12 will have been cut and transferred from the first or infeed conveyor 216 onto the second or rightwardmost conveyor 218.

Figure 3C:
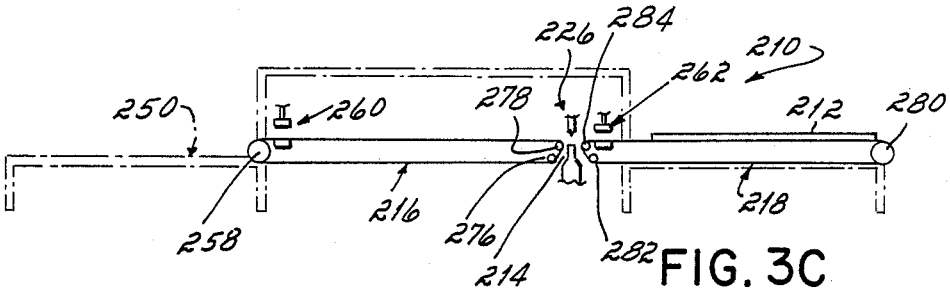

The cut workpiece can move either off-loaded to the right side of the machine or to the left side of the machine. As illustrated in FIG. 3C, the workpiece is off-loaded to the right side of the machine. This is accomplished by unclamping the clamps 260, 262 from the belts so that the complete conveyors 216, 218 are movable to the right as a unit. If the workpiece is to be unloaded to the right side of the machine, the slides and conveyors mounted thereon are moved rightwardly to their rightwardmost position. With the conveyors in their rightwardmost position, as illustrated in FIG. 3C, the drive roller 280 is driven by the drive motor (not shown) associated therewith so as to cause the workpiece 212 to be driven off of the conveyor 218 in a rightward direction. The machine is then ready for movement of the conveyors and carriage to the leftwardmost position preparatory to loading of a new workpiece onto the infeed conveyor 216.

Figure 3D:
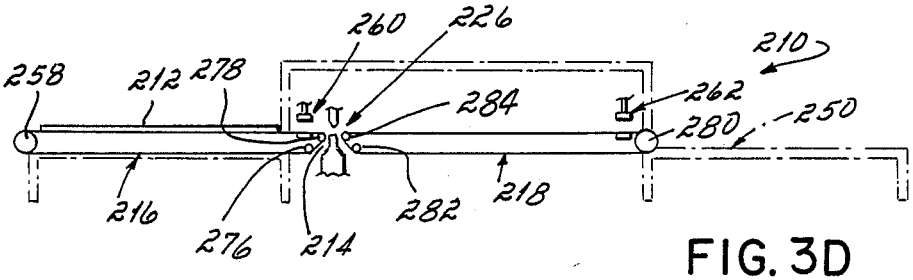

As an alternative to unloading the cutter machine 210 on the right side, the workpiece 212 may be off loaded to the left side of the machine, as illustrated in FIG. 3D. In that event and after completion of the cut through the workpiece, the conveyors are unclamped, and the drive motors associated with the two drive rollers 280, 258 of the conveyors 218, 216 driven in synchronization so as to transport the workpiece 212 from the conveyor 218 onto the conveyor 216. The drive roller 258 of the conveyor 216 may then continue to be driven after the workpiece 212 is completely located on the infeed conveyor 216 so as to drive the workpiece 212 further leftwardly and off the leftwardmost end of the conveyor 216. The machine is then ready for loading of another workpiece onto the upper run of the infeed conveyor 216.

Third Modification of Invention

Figure 4:
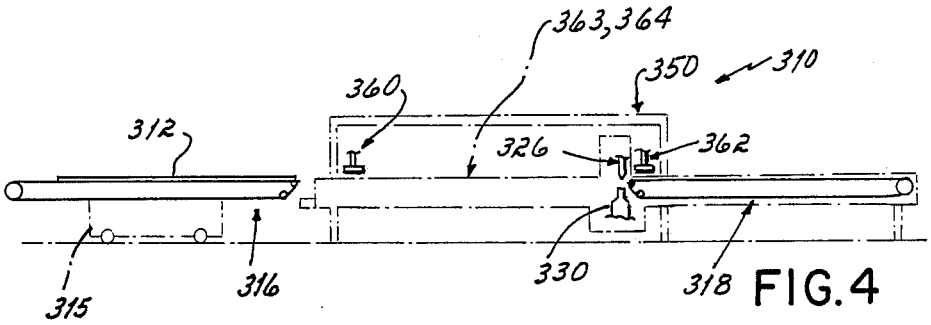
FIG. 4 is a partially diagrammatic, side elevational view of a third embodiment of cutting machine incorporating the invention of this application.
Figure 4A:
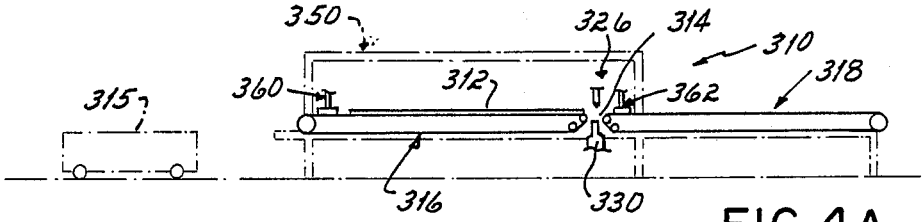
FIGS. 4A–4D are partially diagrammatic, side elevational views of the machine of FIG. 4, illustrating the sequence of operations to load workpieces into the machine, process those workpieces, and unload the workpieces from the machine.
Figure 4B:
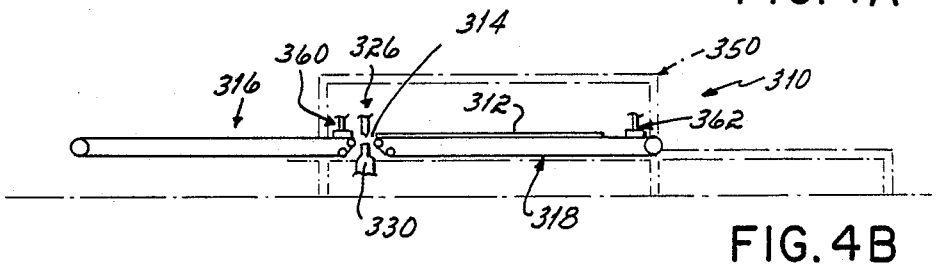
Figure 4C:
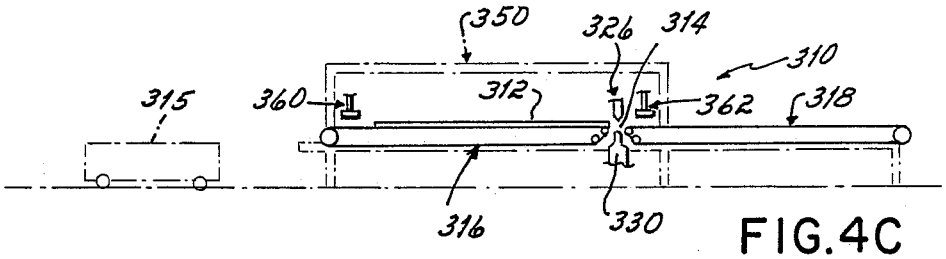
Figure 4D:
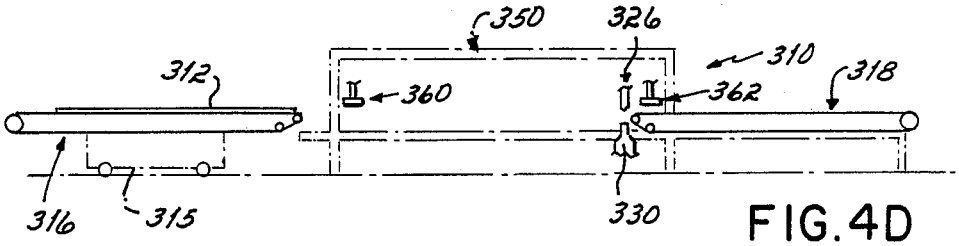

With reference now to FIG. 4, there is illustrated yet another embodiment 310 of the invention of the invention of this application. This embodiment is identical to the embodiment of FIG. 3, except that the infeed conveyor 316 is palletized, i.e., mountable upon a movable cart 315 operative to roll the infeed conveyor 316 into and out of the machine frame 350. When rolled into the machine, the infeed conveyor 316 is drivingly connected to the carriage supporting slides 363, 364 (equivalent to the slides 63, 64 of the FIG. 1 embodiment) on opposite sides of the machine. Once locked to the slides, the cart 315 is removed and the machine operates in exactly the same manner as the cutter machine of FIG. 3. That cycle is illustrated in FIGS. 4A–4D. As illustrated in FIG. 4B, a cycle is commenced after transport of the conveyor 316 into the machine by clamping of the belts of the conveyors 316, 318 against movement. Thereafter, the slides 363, 364 and the carriage mounted thereon are moved leftwardly while fluid issues from the cutter unit 326 into the catcher 330. With the belts clamped and the rollers of the conveyors 316, 318 moving leftwardly, the gap or slot 314 between the ends of the conveyors is moved leftwardly along with the slides 363, 364, thereby cutting the workpiece 312. When the slides and the carriage mounted thereon reach their leftwardmost position, illustrated in FIG. 4B, the workpiece will have been transferred from the infeed conveyor 316 onto the second conveyor 318, and the workpiece will have been completely cut by the fluid jet issuing from the cutter unit 326. In order to return the workpiece to the palletizable infeed conveyor 316, the conveyor roller carrying slides and the carriage are returned to their original rightwardmost position (FIG. 4C) while the belts remain clamped by the clamps 360, 362. This results in the transfer of the finished workpiece 312 back onto the upper run of the infeed conveyor 316. The belts are then unclamped (FIG. 4D), the infeed conveyor 316 released from engagement with the slides and the infeed conveyor, with the finished workpiece 312 mounted thereon, transported out of the machine frame 350 on the movable cart 315.

The advantage of this modification of cutter machine 310 is that it enables workpieces to be loaded onto the infeed conveyor and/or further processed at a location remote from the machine. If multiple infeed conveyors 316 and conveyor transporting carts 315 are utilized, then one workpiece may be loaded onto an infeed conveyor 316 while another identical infeed conveyor is located in the machine and being cut on that machine. This minimizes downtime of the machine which would otherwise occur while workpieces were being unloaded from and loaded onto the single infeed conveyor of the machine.

Fourth Modification of Invention

Figure 5:
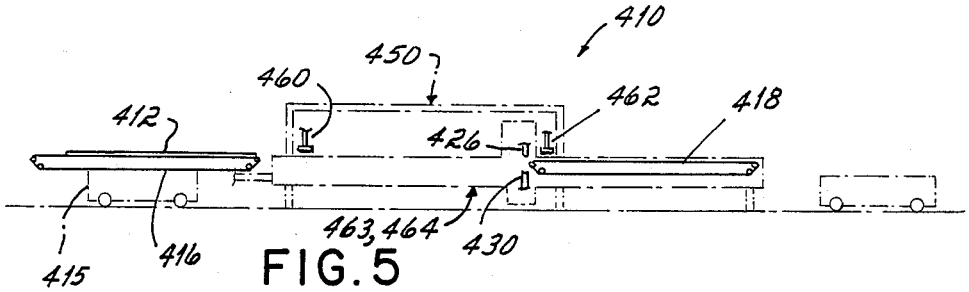
FIG. 5 is a partially diagrammatic, side elevational view of a fourth embodiment of cutting machine incorporating the invention of this application.
Figure 5A:
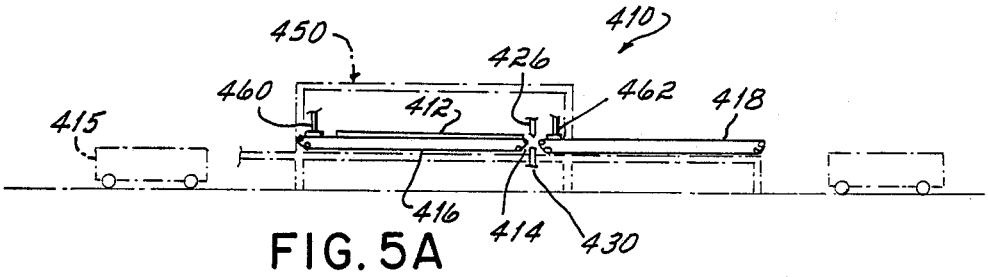
FIGS. 5A–5D are partially diagrammatic side elevational views of the machine of FIG. 5 illustrating the sequence of operations to load workpieces into the machine, process those workpieces, and then unload the workpieces from the machine.
Figure 5B:
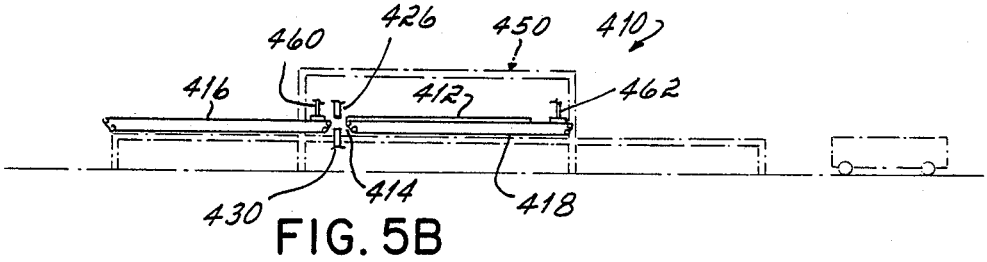

With reference now to FIG. 5 there is illustrated still another embodiment of the invention of this application. The cutter machine 410 of this embodiment is identical to the embodiment of FIG. 4, except that in this embodiment, both conveyors 416 and 418 of the machine are palletizable. In other words, these two conveyors 416, 418 may be independently moved into and moved out of the machine upon movable carts 415 and 419, respectively. As a consequence of this arrangement, workpieces 412 may be loaded onto an infeed conveyor 416 and transported to the machine on the cart 415 while simultaneously finished workpieces on the conveyor 418 are loaded onto a cart 419 and transported out of the machine. With a plurality of conveyors 416 and 418, the conveyors may be quickly cycled through the machine so as to further minimize downtime.

Figure 5C:
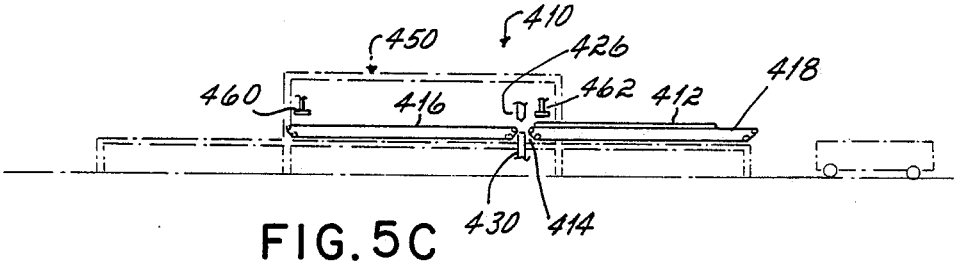
Figure 5D:
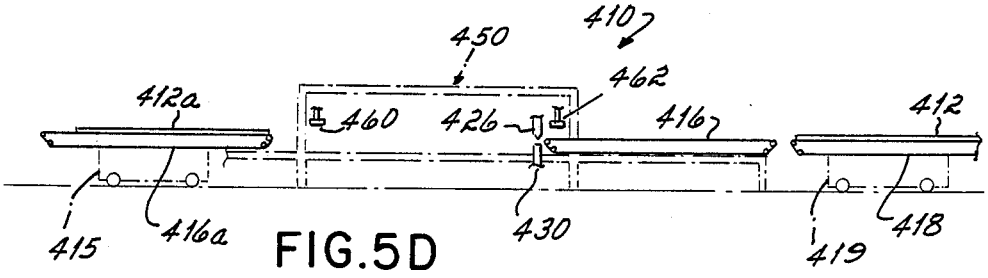

With reference to FIG. 5 and FIGS. 5A–5C, it will be seen that a workpiece is loaded into the machine 410 by transporting that workpiece 412 to the machine on a palletized conveyor 416 mounted upon a movable cart 415. When the conveyor 416 is completely positioned on the machine frame 450, the conveyor 416 is secured to the movable slides 463, 464 (equivalent to the slides 63, 64 of the embodiment of FIG. 1) located on opposite sides of the machine. With the infeed conveyor 416 located within the machine and secured to the movable slides, there is a gap 414 defined between the adjacent ends of the conveyors 416, 418. The cutter unit 426 is located above this gap with the fluid catcher 430 located immediately beneath the nozzle of the fluid jet cutter unit 426. The cutter unit 426 and catcher 430 are both mounted upon the slides 462, 464. In this embodiment, a cutting cycle is initiated by actuating clamps 460, 462 to clamp both belts of both conveyors 416, 418. With the belts clamped against movement relative to the frame 450, movement of the slides to the left is initiated. This results in the gap or slot 414 moving leftwardly, along with the belt supporting rollers of both conveyors 416, 418. During this leftward movement of the slides 463, 464, the cutter unit 426 is actuated so as to offset cutting of the workpiece 412. Thereby, the workpiece is cut in a predetermined pattern. At the completion of the cut, (FIG. 5B) the cutter, as well as the gap, are in their leftwardmost position with the workpiece 412 supported solely upon the upper run of the conveyor 418. The clamps 460, 462 are then disengaged from the conveyors. With the clamps disengaged, the slides 463, 464, along with the conveyors 416, 418 supported therefrom, are moved rightwardly, as illustrated in FIG. 5C, to the rightwardmost extent of the movement of the slides. The finished workpiece may then be removed from the machine while a new workpiece is inserted therein (see FIG. 5D). This is accomplished in this modification of the invention by moving conveyor 418 with the finished workpiece thereon off of the right end of the machine onto a cart 419, while simultaneously, a new conveyor **416*a*, having a new workpiece 412*a*** located thereon, is moved into the left end of the machine. Thus, by using two palletized conveyors, workpieces may be removed from the machine simultaneously with placement of new workpieces into the machine.

While I have described only four preferred embodiments of my invention, persons skilled in the art to which this invention pertains will appreciate numerous changes and modifications which may be made without departing from the spirit of my invention. Therefore, I do not intend to be limited, except by the scope of the following claims.

What is claimed is:

1. A cutting machine comprising a pair of independently operable, longitudinally aligned endless conveyor belts, said belts having upper runs movable in a common horizontal plane, said upper runs of said endless conveyor belts having a length dimension extending longitudinally of said conveyor belts, said belts being adjacent one another and spaced apart to define a longitudinal gap, a cutting medium extendible through said gap for cutting a workpiece positioned over said gap, and means for simultaneously and synchronously moving said gap and said cutting medium longitudinally relative to said workpiece so as to cut said workpiece in a longitudinal direction, said gap moving means being operable to maintain said length dimension of said upper run of at least one of said belts unchanged as said gap is moved relative to said workpiece and said workpiece is transported from said upper run of one of said conveyor belts to the upper run of the other of said conveyor belts.

2. The cutting machine of claim 1 which further includes means for securing at least one point on each of said conveyor belts against longitudinal movement as said gap is moved relative to said workpiece.

3. The cutting machine of claim 1 in which said gap moving means is operable to maintain the length dimension of said upper run of both of said belts unchanged as said gap is moved relative to said workpiece.

4. The cutting machine of claim 1 in which said gap moving means is operable to shorten the length dimension of one of said upper runs of one of said belts as said gap is moved relative to said workpiece.

5. The cutting machine of claim 4 which further includes a take-out conveyor for transporting workpieces out of said machine, said take-out conveyor being movable between a first position out of longitudinal alignment with said pair of endless conveyor belts and a second position in longitudinal alignment with said pair of endless conveyor belts, said take-out conveyor being movable into said second position only when said upper run of one of said belts is shortened.

6. The cutting machine of claim 1 which further includes a take-out conveyor for transporting workpieces out of said machine, said take-out conveyor being movable between a first position out of longitudinal alignment with said pair of endless conveyor belts and a second position in longitudinal alignment with said pair of endless conveyor belts, said take-out conveyor being movable into said second position only after said workpiece has been transported from said upper run of said one of said conveyor belts to the upper run of said other of said conveyor belts.

7. A cutting machine comprising a pair of independently operable, longitudinally aligned endless conveyor belts, said belts having upper runs movable in a common horizontal plane, said upper runs of said endless conveyor belts having a length dimension extending longitudinally of said conveyor belts, said belts being adjacent one another and spaced apart to define a longitudinal gap, a machine frame, a pair of conveyors mounted upon said frame, each conveyor including a plurality of rollers, and each belt being supported upon said rollers of one of said conveyors, cutting means extendible through said gap for cutting a workpiece positioned over said gap, and means for simultaneously and synchronously moving said gap and said cutting means longitudinally relative to said workpiece so as to cut said workpiece in a longitudinal direction, and said gap moving means being operable to maintain said length dimension of said upper run of at least one of said belts unchagned as said gap and cutting means are moved relative to said workpiece, and said workpiece is transported from said upper run of one of said conveyor belts to the upper run of the other of said conveyor belts.

8. The cutting machine of claim 7 which further includes means for securing at least one point on each of said conveyor belts against longitudinal movement as said gap and cutting means are moved relative to said workpiece.

9. The cutting machine of claim 7 in which said gap moving means is operable to maintain said length dimension of said upper run of both of said belts unchanged as said gap and cutting means are moved relative to said workpiece.

10. The cutting machine of claim 7 in which said gap moving means is operable to shorten the length dimension of one of said upper runs of one of said belts as said gap and cutting means are moved relative to said workpiece.

11. The cutting machine of claim 7 wherein at least one of said conveyors is movable between a first position remote from said machine frame and a second position wherein said conveyor is operatively connected to and movable longitudinally with said cutter means on said machine frame.

12. The cutting machine of claim 7 wherein both of said conveyors are movable between a first position remote from said machine frame where workpieces are either loaded onto or removed from said upper runs of said conveyor belts and a second position wherein said conveyors are operatively connected to and movable longitudinally with said cutting means on said machine frame.

13. A method of cutting a workpiece upon a cutting machine having a pair of longitudinally aligned, endless conveyor belts, said belts having upper runs movable in a common horizontal plane, said upper runs of said endless conveyor belts having a length dimension extending longitudinally of said conveyor belts, said belts being adjacent one another and spaced apart to define a gap, said method comprising locating a workpiece upon the upper run of a first one of said belts, simultaneously and synchronously moving said gap and said cutting means longitudinally relative to said workpiece while passing a cutting medium through said gap so as to cut said workpiece in a longitudinal direction, and maintaining said length dimension of said upper run of at least one of said conveyor belts unchanged as said gap is moved longitudinally relative to said workpiece and said workpiece is transported from said upper run of one of said belts to the upper run of the other one of said belts.

14. The method of claim 13 which further comprises securing at least one point on each of said conveyor belts against longitudinal movement as said gap is moved longitudinally relative to said workpiece.

15. The method of claim 13 which comprises maintaining unchanged the length dimension of said upper run of both of said belts as said gap is moved longitudinally relative to said workpiece and said workpiece is transported from the upper run of said first one of said belts to the upper run of the other of said belts.

16. The method of claim 13 which comprises shortening the length dimension of one of said upper runs of one of said belts as said gap is moved relative to said workpiece and said workpiece is transported from the upper run of said first one of said belts to the upper run of the other of said belts.

17. A method of cutting a workpiece upon a cutting machine having a pair of longitudinally aligned endless conveyor belts, said belts having upper runs movable in a common horizontal plane, said upper runs of said endless conveyor belts having a length dimension extending longitudinally of said conveyor belts, said belts being adjacent one another and spaced apart to define a gap, said method comprising locating a workpiece upon the upper run of a first one of said belts, simultaneously and synchronously moving said gap and a cutting medium longitudinally relative to said workpiece while passing said cutting medium through said gap so as to cut said workpiece in a longitudinal direction, and changing the length dimension of said upper run of one of said belts while maintaining the length dimension of the upper run of the other of said belts as said gap is moved longitudinally relative to said workpiece and said workpiece is transported from said upper run of said one of said belts to the upper run of the other one of said belts.

18. A cutting machine comprising a pair of independently operable, longitudinally aligned endless conveyor belts, said belts having upper runs movable in a common horizontal plane, said belts being adjacent one another and spaced apart to define a longitudinal gap, a machine frame, a pair of conveyors, each conveyor including a plurality of rollers, and one of said belts being supported upon said rollers of each of said conveyors, cutting means for directing a cutting medium through said gap, said cutting means including a cutter carriage mounted over said gap, means for simultaneously and synchronously moving said gap and said cutter carriage longitudinally relative to said workpiece while directing said cutting medium through said gap so as to cut said workpiece in a longitudinal direction as said workpiece is transported from said upper run of one of said conveyor belts to the upper run of the other of said conveyor belts, and at least one of said conveyors being movable between a first position remote from said machine frame and a second position wherein said one conveyor is mounted on said machine frame and is operatively connected to said cutting carriage for longitudinal movement therewith.

19. The cutting machine of claim 18 which further includes means mounted on said machine frame for securing at least one point on each of said conveyor belts against longitudinal movement as said gap and cutter carriage are moved relative to said workpiece.

20. The cutting machine of claim 18 wherein both of said conveyors are movable between a first position remote from said machine frame where workpiece are either loaded onto or removed from said upper runs of said conveyor belts and a second position wherein said conveyors are operatively connected to and longitudinally movable with said cutter carriage on said machine frame.

21. A travelling gap conveyor comprising a pair of independently operable, longitudinally aligned endless conveyor belts, said belts having upper runs movable in a common horizontal plane, said upper runs of said endless conveyor belts having a length dimension extending longitudinally of said conveyor belts, said belts being adjacent one another and spaced apart to define a longitudinal gap, a workpiece supported on said conveyors over said gap, and means for simultaneously and synchronously moving said gap longitudinally relative to said workpiece, said gap moving means being operable to move said gap while maintaining said length dimension of said upper run of at least one of said belts unchanged as said gap is moved relative to said workpiece and said workpiece is transported from said upper run of one of said conveyor belts to the upper run of the other of said conveyor belts.

22. The travelling gap conveyor of claim 21 which further includes means for securing at least one point on each of said conveyor belts against longitudinal movement as said gap is moved relative to said workpiece.

23. The travelling gap conveyor of claim 21 in which said gap moving means is operable to maintain said length dimension of said upper run of both of said belts unchanged as said gap is moved relative to said workpiece.

24. The travelling gap conveyor of claim 21 in which said gap moving means is operable to shorten the length dimension of one of said upper runs of one of said belts as said gap is moved relative to said workpiece.

25. The travelling gap conveyor of claim 24 which further includes a take-out conveyor for transporting workpieces out of said machine, said take-out conveyor being movable between a first position out of longitudinal alignment with said pair of endless conveyor belts and a second position in longitudinal alignment with said pair of endless conveyor belts, said take-out conveyor being movable into said second position only when said upper run of one of said belts is shortened.

26. The travelling gap conveyor of claim 21 which further includes a take-out conveyor for transporting workpieces out of said machine, said take-out conveyor being movable between a first position out of longitudinal alignment with said pair of endless conveyor belts and a second position in longitudinal alignment with said pair of endless conveyor belts, said take-out conveyor being movable into said second position only after said workpiece has been transported from said upper run of said one of said conveyor belts to the upper run of said other of said conveyor belts.

27. A travelling gap conveyor comprising a pair of independently operable, longitudinally aligned endless conveyor belts, said belts having upper runs movable in a common horizontal plane, said upper runs of said endless conveyor belts having a length dimension extending longitudinally of said conveyor belts, said belts being adjacent one another and spaced apart to define a longitudinal gap, a machine frame, a pair of conveyors, each conveyor including a plurality of rollers, and each belt being supported upon said rollers of one of said conveyors, a workpiece positioned over said gap, and means for simultaneously and synchronously moving said gap longitudinally relative to said workpiece, said gap moving means being operable to maintain said length dimension of said upper run of at least one of said belts unchanged as said gap is moved relative to said workpiece, and said workpiece is transported from said upper run of one of said conveyor belts to the upper run of the other of said conveyor belts.

28. The travelling gap conveyor of claim 27 which further includes means for securing at least one point on each of said conveyor belts against longitudinal movement as said gap is moved relative to said workpiece.

29. The travelling gap conveyor of claim 27 in which said gap moving means is operable to maintain said length dimension of said upper run of both of said belts unchanged as said gap is moved relative to said workpiece.

30. The travelling gap conveyor of claim 27 in which said gap moving means is operable to shorten said length dimension of one of said upper runs of one of said belts as said gap is moved relative to said workpiece.

31. The travelling gap conveyor of claim 27 wherein at least one of said conveyors is movable between a first position remote from said machine frame and a second position wherein said one conveyor is mounted on said frame and is operatively connected to said gap moving means.

32. The travelling gap conveyor of claim 27 wherein both of said conveyors are movable between a first position remote from said machine frame where workpieces are either loaded onto or removed from said upper runs of said conveyor belts and a second position wherein said conveyors are operatively connected to said gap moving means on said machine frame.

33. A method of conveying a workpiece upon a machine having a pair of longitudinally aligned, endless conveyor belts, said belts having upper runs movable in a common horizontal plane, said upper runs of said endless conveyor belts having a length dimension extending longitudinally of said conveyor belts, said belts being adjacent one another and spaced apart to define a gap, said method comprising locating a workpiece upon the upper run of a first one of said belts, moving said gap longitudinally relative to said workpiece, and maintaining said length dimension of said upper run of at least one of said conveyor belts unchanged as said gap is moved longitudinally relative to said workpiece and said workpiece is transported from said upper run of one of said belts to the upper run of the other one of said belts.

34. The method of claim 33 which further comprises securing at least one point on each of said conveyor belts against longitudinal movement as said gap is moved longitudinally relative to said workpiece.

35. The method of claim 33 which comprises maintaining unchanged the length dimension of said upper run of both of said belts as said gap is moved longitudinally relative to said workpiece and said workpiece is transported from the upper run of said first one of said belts to the upper run of the other of said belts.

36. The method of claim 33 which comprises shortening the length dimension of one of said upper runs of one of said belts as said gap is moved relative to said workpiece and said workpiece is transported from the upper run of said first one of said belts to the upper run of the other of said belts.

37. A method of conveying a workpiece upon a machine having a pair of longitudinally aligned endless conveyor belts, said belts having upper runs movable in a common horizontal plane, said upper runs of said endless conveyor belts having a length dimension extending longitudinally of said conveyor belts, said belts being adjacent one another and spaced apart to define a gap, said method comprising locating a workpiece upon the upper run of a first one of said belts, moving said gap longitudinally relative to said workpiece, and changing the length dimension of said upper run of one of said belts while maintaining the length dimension of the upper run of the other of said belts as said gap is moved longitudinally relative to said workpiece and said workpiece is transported from said upper run of said one of said belts to the upper run of the other one of said belts.

38. A travelling gap conveying machine comprising a pair of independently operable, longitudinally aligned endless conveyor belts, said belts having upper runs movable in a common horizontal plane, said belts being adjacent one another and spaced apart to define a longitudinal gap, a machine frame, a pair of conveyors, each conveyor including a plurality of rollers, and one of said belts being supported upon said rollers of each of said conveyors, a tool carriage mounted over said gap, means for simultaneously and synchronously moving said gap and said tool carriage longitudinally relative to said workpiece as said workpiece is transported from said upper run of one of said conveyor belts to the upper run of the other of said conveyor belts, and at least one of said conveyors being movable between a first position remote from said machine frame and a second position wherein said one conveyor is mounted on said machine frame.

39. The machine of claim 38 which further includes means mounted on said machine frame for securing at least one point on each of said conveyor belts against longitudinal movement as said gap and tool carriage are moved relative to said workpiece.

40. The machine of claim 38 wherein both of said conveyors are movable between a first position remote from said machine frame where workpieces are either loaded onto or removed from said upper runs of said conveyor belts and a second position wherein said conveyors are mounted upon said machine frame.

* * * * *